US005618602A

United States Patent [19]

Nelson

[11] Patent Number: 5,618,602

[45] Date of Patent: Apr. 8, 1997

[54] ARTICLES WITH TONGUE AND GROOVE JOINT AND METHOD OF MAKING SUCH A JOINT

[76] Inventor: Thomas J. Nelson, 3209-B Iris Cir., Temple, Tex. 76502

[21] Appl. No.: 409,221

[22] Filed: Mar. 22, 1995

[51] Int. Cl.[6] ..... B32B 3/06

[52] U.S. Cl. ..... 428/60; 428/58; 428/192; 52/591.1; 52/592.1

[58] Field of Search ..... 428/60, 58, 192; 52/592.1, 591.1

[56] References Cited

U.S. PATENT DOCUMENTS

| | | | |
|---|---|---|---|
| 890,436 | 6/1908 | Momberg | 52/592.1 |
| 4,471,012 | 9/1984 | Maxwell | 428/106 |

FOREIGN PATENT DOCUMENTS

| | | | |
|---|---|---|---|
| 357539 | 11/1961 | Switzerland | 52/592.1 |

*Primary Examiner*—Alexander Thomas

[57] ABSTRACT

Disclosed is laminate flooring and other articles with tongues and grooves for joining sections of the flooring or articles and a method of making the tongue and groove joints. The lower surfaces of the tongues and grooves are indexing surfaces for aligning the wear surfaces of the flooring sections. The tongues and grooves are made such that when the tongue is fully inserted into the groove, a continuous space is formed between the upper surface of the tongue and groove. The grooved edges are cut at an acute angle to the surface. This provides a space between the upper surfaces of the tongue and groove and between the edge surfaces above the tongues and grooves toward the wear surfaces of the flooring sections. Glue in the joint, upon curing, resists penetration of moisture and increases the strength of the joint.

16 Claims, 6 Drawing Sheets

ARTICLES WITH TONGUE AND GROOVE JOINT AND METHOD OF MAKING SUCH A JOINT

BACKGROUND OF THE INVENTION

1. Field of the Invention

This invention relates to tongue and groove joints. These joints are particularly useful for joining pieces of laminate flooring. Glue in these joints resists penetration of moisture.

2. Description of the Related Art

Commercially available laminate flooring generally includes a wear surface glued to a substrate. The wear surface generally is high-wear resistant decorative laminate. The substrate generally is fiber board or particle board. Each piece of laminate flooring generally has a groove along one end and one side suitable for joining with a tongue along one side or end of an adjacent piece of laminate flooring.

While such laminate flooring has found wide acceptance in Europe as flooring, it is not substantially used in the United States. In part the reason may be due to installation difficulties and the lack of moisture resistance in the joint areas.

Laminate flooring is assembled by placing glue in the groove and inserting the tongue of one piece into the groove of an adjacent piece. A substantially complementary fit of a tongue and groove results in difficulty in aligning the tongue and groove. Additionally, as the glue is absorbed into substrate, the substrate swells, causing the groove to tightly squeeze the tongue. This can make full insertion of the tongue into the groove extremely difficult. Furthermore, as the tongue and groove are moved together, glue can be compressed in the groove by the tongue in a piston fashion. This can increase the difficulty in abutting the wear surfaces of adjacent laminate flooring pieces.

To overcome this assembly problem, laminate flooring manufactures offer special tools for assembling pieces of laminate flooring.

One such special tool is a hammering aid that has a flat surface and complementary tongue and groove engaging surfaces. When difficulty is encountered in abutting the wear surfaces of adjacent pieces, the hammering aid is placed along the edge of the laminate. The flat surface of the hammering aid is then struck with a hammer repeatedly to apply a force to the joint and force the tongue and groove together.

However, even with the use of a hammering aid, a gap can remain between adjacent pieces. The gap is unsightly and allows for damaging penetration of moisture to the substrate. The problem with moisture penetration into the joint is that it can cause the substrate to swell. Excess swelling damages laminate flooring.

Laminate flooring with tongue and groove joints are difficult to manufacture. The tight complementary fit between the tongue and groove requires attention be paid to cutting tolerances for the widths of the tongue and groove. An interesting yet problematic phenomenon occurs during the process of cutting the tongues and grooves. The cutting process itself progressively dulls and wears the cutting blades. As the blades progressively wear, grooves of later cut articles are progressively narrower than grooves of earlier cut articles. Likewise, tongues of later cut articles are progressively wider than tongues of earlier cut articles. Unfortunately, at some point, the widths of the tongues and grooves are not within acceptable tolerances.

Thus there is a need in the art for an improved tongue and grooved joint. There is a need for a tongue and groove joint that does not require special tools for installation. There is a need for a moisture resistant tongue and groove joint. These and other needs will become apparent to those of skill in the art upon review of this specification, including its claims and drawings.

SUMMARY OF THE INVENTION

It is one object of the present invention to provide for an improved tongue and grooved joint.

It is even another object of the present invention to provide for a tongue and grooved joint that does not require special tools for installation.

It is yet another object of the present invention to provide for a moisture resistant tongue and groove joint.

These and other objects of the present invention will become apparent to those of skill in the art upon review of this specification, including its claims and drawings.

An article of the present invention has a planar, decorative wear surface, a grooved edge and a tongued edge. The tongued edge has a tongue with a planar lower surface positioned an index distance from and parallel to the planar decorative surface. The grooved surface has a groove with a planar lower surface positioned the index distance from and parallel to the planar decorative surface. The upper surfaces of the tongue and groove are shaped and sized such that upon joining two pieces of the article by positioning the lower surfaces of the tongues and grooves together and moving the tongue of one piece into the groove of another piece, liquid glue placed in the groove will be squeezed out between the upper surfaces of the tongue and groove and upwardly between the tongued and grooved edge toward the decorative surfaces of the two pieces. This joint can be assembled without the use of special tools and the glue acts as a barrier to water damage to substrate of laminate flooring.

The tongue has a beveled surface extending from the end surface to the upper surface of the tongue. The beveled surface can form an oblique angle to the upper surface of the tongue. Preferably more than about one half and most preferably more than about two thirds of the length of upper surface of the tongue remains after the beveled surface is cut. A space for glue to be squeezed through is provided between the upper surfaces of tongues and grooves upon joining pieces of the article. A space for glue to be squeezed through is also provided between a planar surface above the tongue and a planar surface above the groove. The planar surface above the tongue forms a right angle to the decorative surface. The planar surface above the groove forms an acute angle to the decorative surface The acute angle can be about 82.5 to 87.5 degrees. A space is provided between a planar surface below the tongue and a planar surface below the groove. The planar surface below the tongue forms a right angle to the decorative surface. The planar surface below the groove forms an acute angle to the decorative surface The acute angle can be about 82.5 to 87.5 degrees.

DETAILED DESCRIPTION OF THE INVENTION

Figure 1:
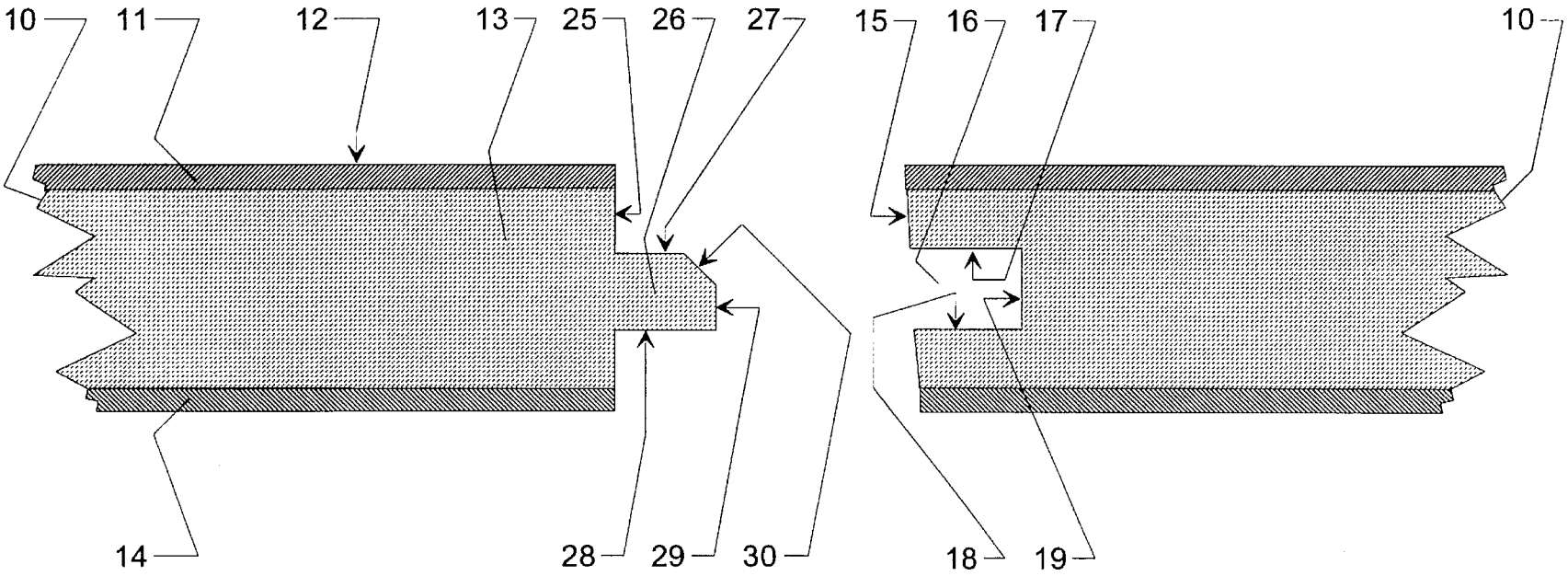
FIG. 1 is a side-view of the tongue and groove joint of the present invention.

The tongue and groove joint of the present invention is described with reference to laminate flooring. However, the present invention is applicable to other articles that can be joined with tongue and groove joints.

Features and functions of the tongue and groove joint of the present invention are shown in side views of pieces of laminate flooring 10 on FIGS. 1–4. A piece of laminate flooring 10 is shown on FIG. 1 with a rectangular tongue 26 on a planar tongued edge 25. Another piece of laminate flooring 10 is shown on FIG. 1 with a rectangular groove 16 on a planar grooved edge 15.

Additional features of laminate flooring are decorative laminate 11, substrate 13, and backer 14. The decorative laminate provides a wear surface 12. The tongue 26 and groove 16 are cut in the substrate. It is believed that particle board, fiberboard or plywood can be suitable substrates 13 for laminate flooring. A backer 14 is believed to be required when laminate flooring is to be installed on a flexible pad. The backer 14 provides dimensional stability to the laminate flooring and can be a moisture barrier. It is believed that a backer is not required for laminate flooring that will be glued to an existing floor.

The tongue 26 and groove 16 are shown on FIG. 1 as having planar lower surfaces, 28 and 18 respectively. These planar lower surfaces are parallel with and an indexing distance from planar wear surface 12. Abutment of the planar lower surface 28 of tongue 26 and the planar lower surface 18 of groove 16 during the joining of the tongue and groove, as shown on FIGS. 2 through 4, causes indexing of wear surfaces 12 of pieces of laminate flooring 10.

Figure 3:
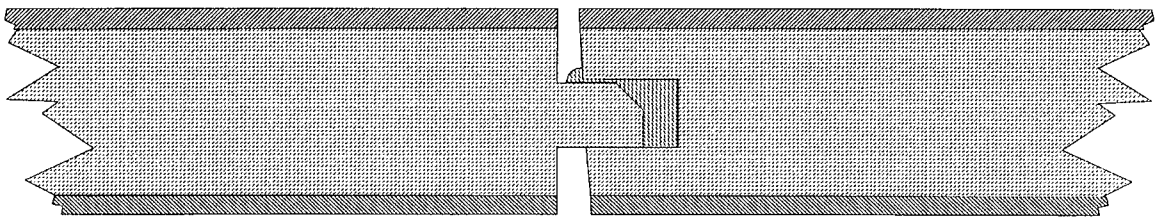
FIG. 3 is a side-view of an assembly step of the tongue and groove joint of the present invention showing the tongue in contact with glue in the groove and the glue being squeezed out.
Figure 4:
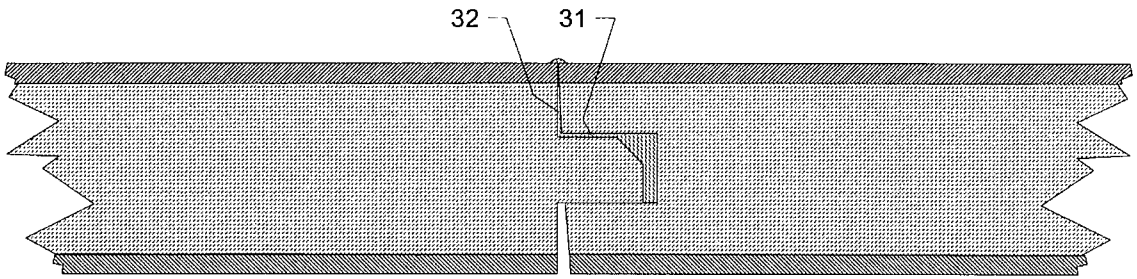
FIG. 4 is a side-view showing the tongue and groove of the present invention being fully joined and glue squeezed out to the wear surface.
Figure 5:
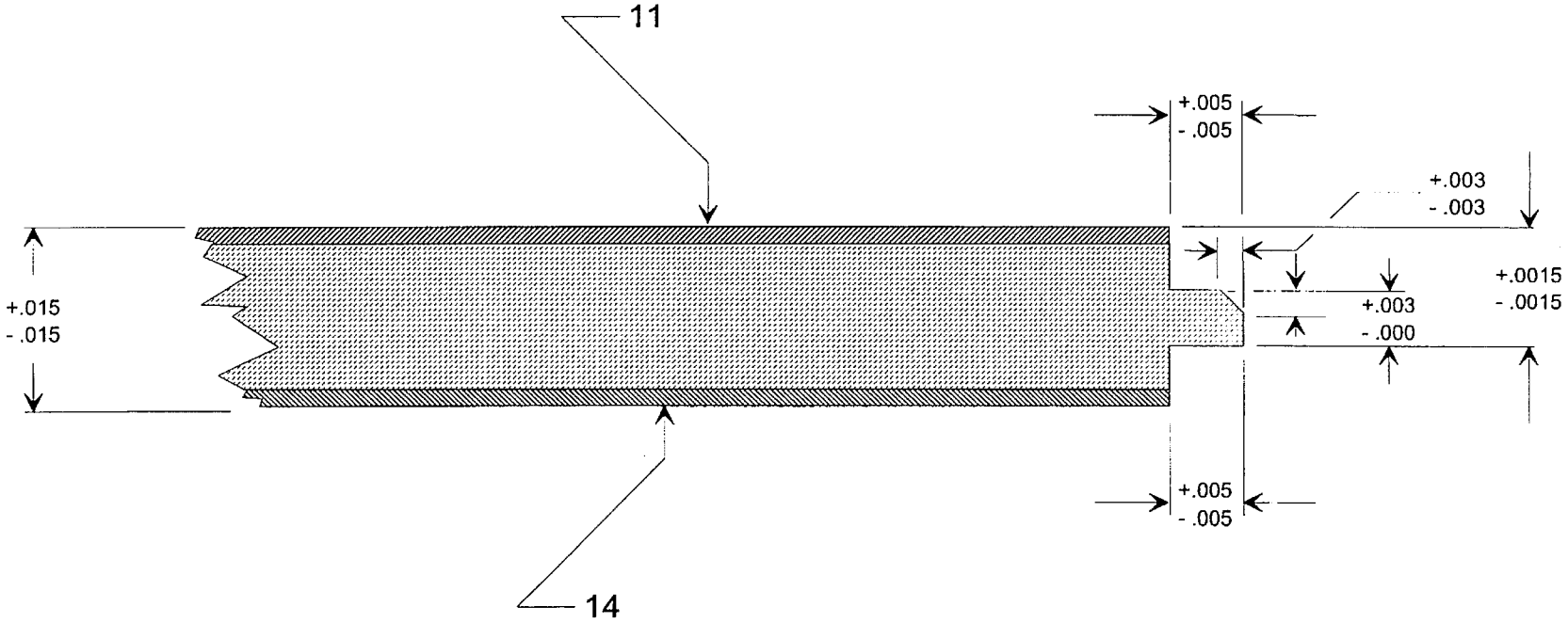
FIGS. 5–8 show the dimensions of an embodiment of the tongue and groove joint of the present invention in English and Metric units.
Figure 6:
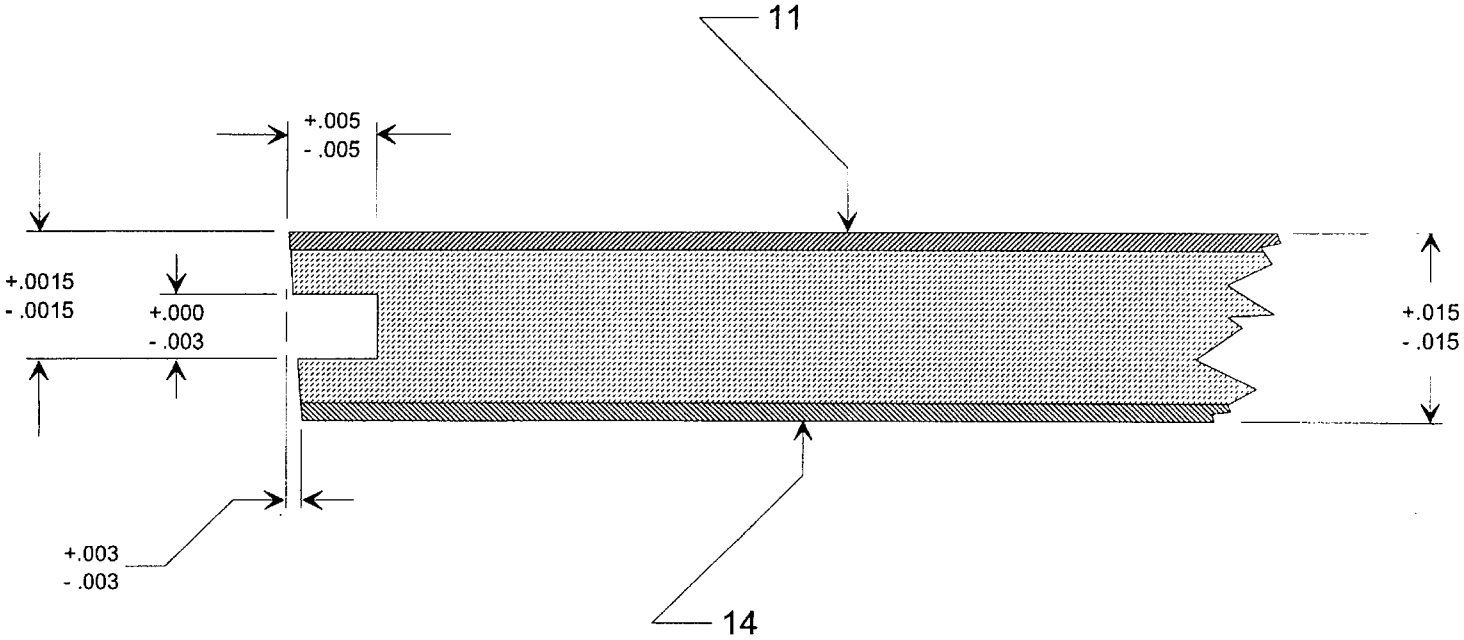
Figure 7:
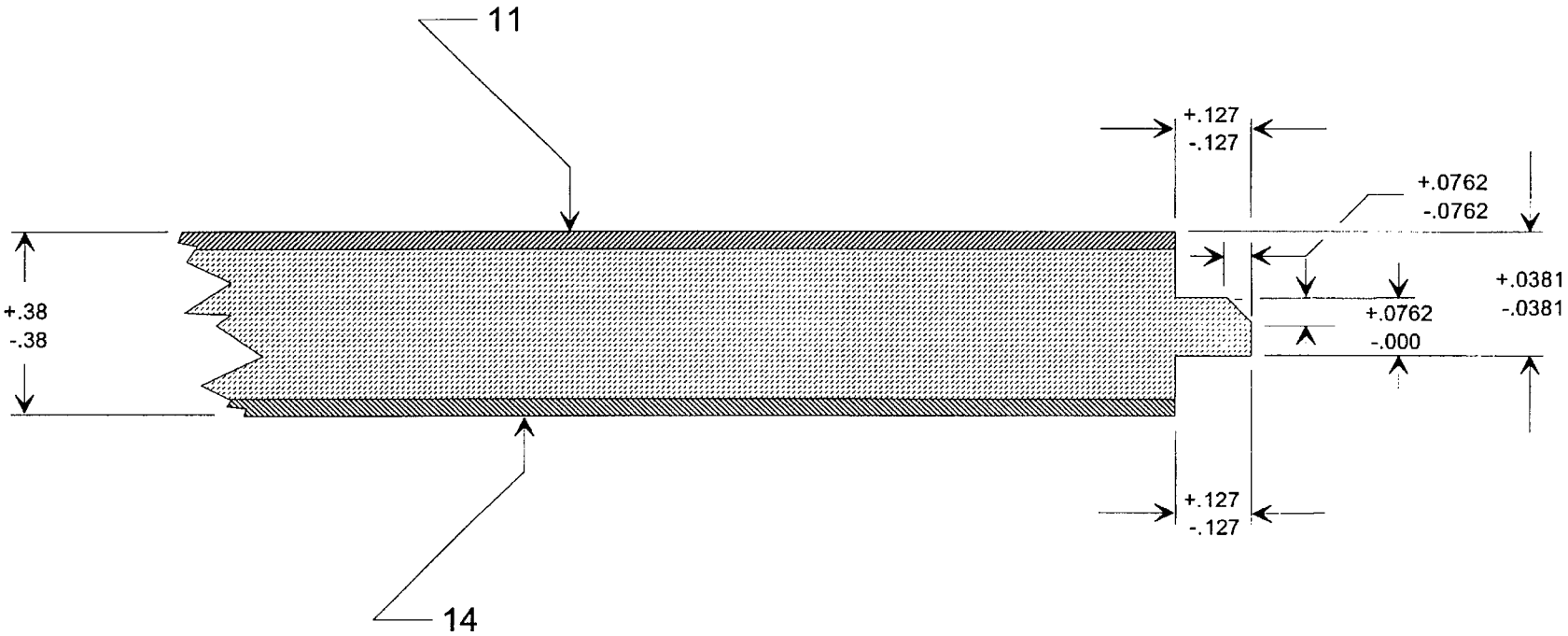
Figure 8:
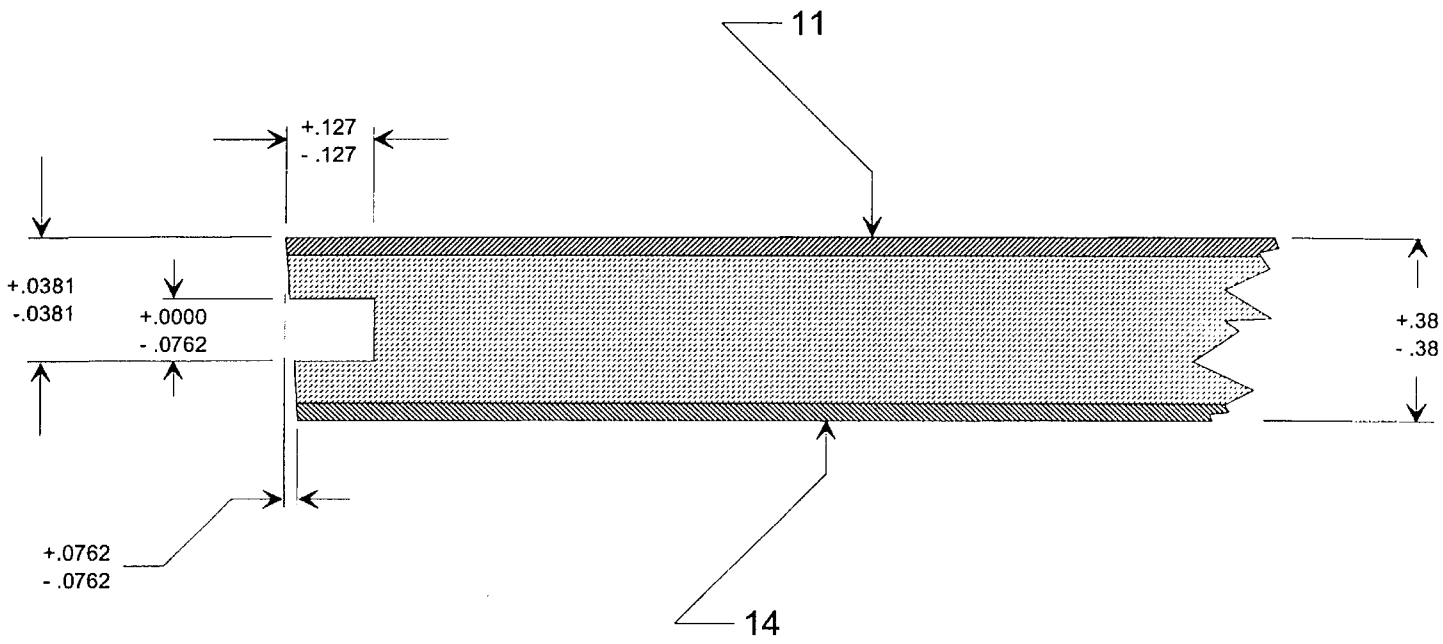

The tongue 26 and groove 16 are shown on FIGS. 3 and 4 as having planar upper surfaces, 27 and 17 respectively. These planar upper surfaces are parallel and spaced apart. This space provides a flow path for glue to flow during the joining of the tongue and groove joint of this invention.

The planar tongued and grooved edges, 25 and 15 respectively, above and below the tongue 26 and groove 16 are shown on FIG. 4 as not being parallel. The planar tongued edge 25 is cut at a right angle (90 degrees) to the wear surface. The planar grooved edge 15 is cut at an acute angle (less than 90 degrees) to the wear surface. This provides a space above tongue 26 and groove 16 for glue 20 to flow to the wear surface 12 of laminate flooring 10. It is believed that this acute angle should be about 82.5 to 87.5 degrees. An acute angle above about 87.5 degrees will not provide sufficient space for viscous glue to flow to the wear surface 12. An acute angle of less than about 82.5 degrees will result in a larger space than required. Water absorbed by the substrate from the excess glue could swell the substrate and separate the planar tongued and grooved edges, 25 and 15 respectively. This also provides a space below the tongue 26 and groove 16 for the substrate to absorb moisture and swell without damaging the laminate flooring. It is believed that this swelling will not apply pressure for separating the planar tongued and grooved edges, 25 and 15 respectively.

Tongue 26 is shown as having a beveled surface 30 extending from its end surface 29 to its upper surface 27. The bevel is shown as cut at an oblique (45 degree) angle to the upper 27 and end 29 surfaces of the tongue 26. The beveled surface 30 can serve as a guide during the joining of tongue 26 and groove 16.

Figure 2:
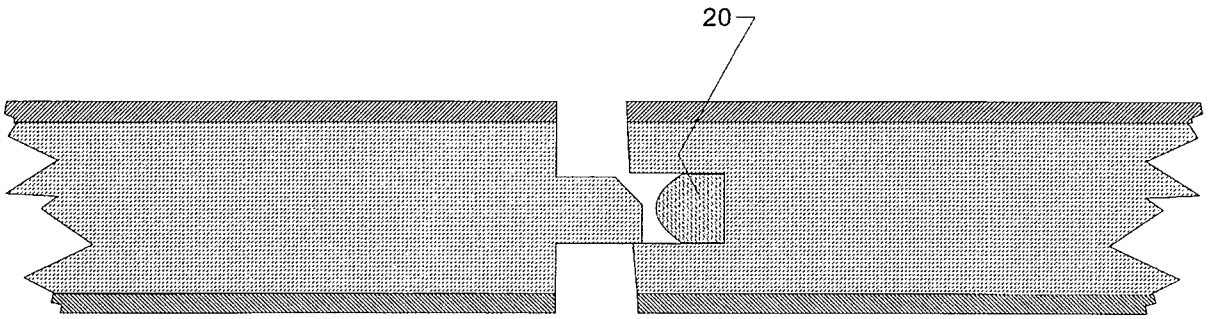
FIG. 2 is a side-view of an assembly step of the tongue and groove joint of the present invention showing glue placed in the groove and the tongue entering the groove.

Glue 20 is shown on FIG. 2 in the end 19 of groove 16. Glue 20, after curing, adheres the tongue and groove joint together and acts as a barrier against moisture penetration to the substrate 13. Commercially available wood glues are suitable to adhere the tongue and groove joint together. Franklin Titebond II Wood Glue, which is available from Franklin International of Columbus, Ohio is believed to be suitable for joining laminate flooring. Franklin Titebond II Wood Glue is believed to be a polyvinyl acetate emulsion adhesive. When laminate flooring is installed on a flexible pad, it is believed to be desirable for the glue to be somewhat flexible. It is thought that flexibility of the glue, after curing, can better accommodate depression of laminate flooring at the tongue and groove joint of this invention.

Additional features and functions of the tongue and groove joint of this invention are shown on FIGS. 2 through 4. As the tongue and groove of two pieces of laminate flooring 10 are joined, tongue 26 applies pressure to liquid glue 20 in groove 16. Glue 20 flows past beveled edge 30 and through space 31 between the upper surface 27 of tongue 26 and the upper surface 17 of groove 16. The lower surfaces 28 of tongue 26 and the lower surface 18 of groove 16 are abutted, thereby providing an impediment to glue flowing between the lower surfaces 28 and 18 of the tongue and groove.

The beveled surface 30, as shown of FIG. 4, reduces the length of the upper surface 27 of tongue 26 and the upper surface 17 of groove 16 as compared to the lengths of the surfaces of a rectangular tongue. This is believed to aid in glue 20 flowing, preferentially, between the upper surfaces of tongue 26 and groove 16 during the joining of pieces of laminate flooring 10. The abutment and length of the lower surfaces, 28 and 18 respectively, of tongue 26 and groove 16 is also believed to aid in glue 20 flowing, preferentially, between the upper surfaces of tongue 26 and groove 16 during the joining of pieces of laminate flooring 10. Additionally, it is believed that pressure created on the glue 20 during the joining of the tongue 26 and groove 16, as shown on FIGS. 3 and 4, will be transmitted, in part, downwardly on upper surface 27 and beveled surface 30 of tongue 26. This pressure can also aid in glue 20 flowing, preferentially, between the upper surfaces of tongue 26 and groove 16 during the joining of pieces of laminate flooring 10.

The curing of the glue 20 involves the loss of solvent, water in the case of Franklin Titebond II Wood Glue, to the substrate 13. Water causes swelling of the substrate. It is believed necessary to limit the volume of glue 20 that will cure by losing water or other solvent to the substrate 13. This is accomplished in the embodiment of this invention as shown on FIGS. 1–4 by limiting the distance between (1) the end 19 of groove 16 and the end 29 of tongue 26, (2) the amount of the tongue that is cut off in making beveled surface 30, (3) the space 31 between the upper surface 27 of tongue 26 and the upper surface 17 of groove 16 and (4) the space 32 between planar tongued edge 25 and planar grooved edge 15 above tongue 26 and groove 16, respectively.

It is believed that swelling of the substrate at the upper surfaces of the tongue and groove, 27 and 17 respectively, aids in holding the tongue and groove joint of this invention together. Therefore, it is believed that no more than one half and preferably no more than one third of the upper surface 27 of tongue 26 should be removed in cutting the beveled surface 30 on tongue 26. The space between the upper surfaces of the tongue and groove should be limited to the space required for glue to preferentially flow to the wear surface 12 when tongue 26 and groove 16 are joined. It is believed that excess space can result in damage to laminate flooring. Glue loses water to the substrate 13 adjacent space 31 during the curing of the glue. Some swelling is beneficial for producing a tight tongue and groove joint. However, excess swelling damages laminate flooring.

Sufficient glue 20 should be placed in the end 19 of the groove 16 such that a portion of the glue will flow to the wear surface 12 as the tongue and groove joint of this invention is joined. Additional glue is not beneficial and increases the cleanup efforts.

A laminate flooring embodiment of the tongue and groove joint of this invention shown on FIGS. 5 through 8. The dimensions of the features of laminate flooring are preferred dimensions for the embodiment shown. The tolerances are preferred tolerances for the embodiment shown. Dimensions and tolerances are shown on FIGS. 5 and 6 in inches. Dimensions and tolerances shown on FIGS. 7 and 8 in millimeters.

The tolerances for cutting the upper and lower surfaces of the tongue and groove are different. It is shown on FIGS. 5–8 that the lower surfaces, 28 and 18 respectively, of the tongues and grooves are cut to be 0.2±0.0015 inches (5.08±0.0381 millimeters) from the wear surface 12. The upper surface 27 is cut for the tongue 26 to have a minimum width of 0.09 inches (2.286 millimeters) and to increase in width by up to 0.003 inches (0.0762 millimeters) during the cutting of the tongue. The upper surface 17 is cut for the groove to have a maximum width of 0.1 inches (2.54 millimeters) and to decrease in width by up to 0.003 inches (0.0762 millimeters) during the cutting of the groove. This provides a minimum space 31 between the upper surface 27 of tongue 26 and the upper surface 17 of groove 16 of 0.004 inches (0.1016 millimeters).

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty that reside in the present invention, including all features that would be treated as equivalents thereof by those skilled the art to which this invention pertains.

Additionally, while the present invention has been illustrated with respect to laminate flooring, it is to be understood that the tongue and groove of the present invention may be utilized in any application in which it is desired to have a tongue and groove joint, including but not limited to flooring in general, furniture, cabinets, countertops and wall paneling.

I claim:

1. An article having a planar, decorative wear surface, a grooved edge and a tongued edge, wherein the tongue and groove have planar lower surfaces positioned the same distance from and parallel to the planar decorative surface, and wherein the upper surfaces of the tongue and groove are parallel, planar surfaces and wherein the upper surface of the groove is closer to the planar decorative surface than the upper surface of the tongue such that upon joining two pieces of the article by positioning the lower surfaces of the tongues and grooves together and moving the tongue of one piece into the groove of another piece, liquid glue placed in the groove will be squeezed out between the upper surfaces of the tongue and groove and upwardly between the tongued and grooved edge toward the decorative surfaces of the two pieces.

2. The article of claim 1, wherein the tongue has a beveled surface extending from the end surface to the upper surface of the tongue.

3. The article of claim 2, wherein the beveled surface forms an oblique angle to the upper surface of the tongue.

4. The article of claim 2, wherein more than about one half of the length of upper surface of the tongue remains after the beveled surface is formed.

5. The article of claim 2, wherein more than about two thirds of the length of upper surface of the tongue remains after the beveled surface is formed.

6. The article of claim 1, wherein the tongued edge has a planar surface extending at a right angle from the planar decorative surface to the upper surface of the tongue and the grooved edge has a planar surface extending at an acute angle from the planar decorative surface to the upper surface of the groove for providing a space above the tongue and groove upon joining two pieces of the article.

7. The article of claim 6, wherein the acute angle is about 82.5 to 87.5 degrees.

8. The article of claim 1, wherein the tongued edge has a planar surface extending at a right angle from the planar lower surface of the tongue and the grooved edge has a planar surface extending from the planar lower surface of the groove at an acute angle to the planar decorative surface for providing a space below the tongue and groove upon joining two pieces of the article.

9. The article of claim 1, wherein the acute angle is about 82.5 to 87.5 degrees.

10. The method of claim 1 wherein the upper surface of the groove is at least 0.004 inches (0.1016 millimeters) closer to the planar decorative surface than the upper surface of the tongue.

11. A method of making a tongue and a groove along joining edges of an article having a decorative wear surface and a grooved joining side and a tongued joining side, comprising:

forming along the grooved joining side a groove having planar upper and lower surfaces;

forming along the tongued joining side a tongue having planar upper and lower surfaces;

wherein the planar lower surfaces are formed the same distance from and parallel to the decorative wear surface, and wherein the upper surface of the groove is formed closer to the planar decorative surface than the upper surface of the tongue such that upon joining two pieces of the article by positioning the lower surfaces of the tongues and grooves together and moving the tongues into the grooves, liquid adhesive placed in the groove will be squeezed out over the tongue and toward the decorative wear surfaces of the two pieces of the article.

12. The method of claim 11 wherein the decorative wear surface comprises a high pressure decorative laminate.

13. The method of claim 11 wherein the grooved joining side and the decorative wear surface are oriented at an angle of less than 90.

14. The method of claim 11 wherein the article comprises fiber board.

15. The method of claim 11 wherein the article comprises medium density fiber board.

16. The method of claim 11 wherein the upper surface of the groove is at least 0.004 inches (0.1016 millimeters) closer to the planar decorative surface than the upper surface of the tongue.

* * * * *